US007445584B2

(12) United States Patent
Wu

(10) Patent No.: US 7,445,584 B2
(45) Date of Patent: Nov. 4, 2008

(54) HANDS AND FEET EXERCISER

(75) Inventor: Shen Yi Wu, Taichung (TW)

(73) Assignee: Strength Master Fitness Tech Co., Ltd., Taichung (TW)

( * ) Notice: Subject to any disclaimer, the term of this patent is extended or adjusted under 35 U.S.C. 154(b) by 139 days.

(21) Appl. No.: 11/702,138

(22) Filed: Feb. 5, 2007

(65) Prior Publication Data

US 2008/0188359 A1 Aug. 7, 2008

(51) Int. Cl.
*A63B 22/06* (2006.01)
*A63B 22/04* (2006.01)

(52) U.S. Cl. ..... 482/57; 482/52; 482/62

(58) Field of Classification Search ..... 482/52, 482/53, 57, 62, 72; 280/232, 233; 74/594.1
See application file for complete search history.

(56) References Cited

U.S. PATENT DOCUMENTS 5,261,294 A * 11/1993 Ticer et al. ..... 74/594.1
6,042,518 A * 3/2000 Hildebrandt et al. ..... 482/57
6,475,122 B2 * 11/2002 Wu ..... 482/57
6,932,745 B1 * 8/2005 Ellis ..... 482/52
6,945,915 B2 * 9/2005 Wu ..... 482/57
7,381,158 B2 * 6/2008 Girard et al. ..... 482/51

* cited by examiner

*Primary Examiner*—Loan H Thanh
*Assistant Examiner*—Allana Lewin
(74) *Attorney, Agent, or Firm*—Rosenberg, Klein & Lee

(57) ABSTRACT

An exerciser includes a right pedal and a left pedal, both of which are alternatively operated by the user to drive the right and left links so as to move the right and left swinging arms respectively, such that the hands and feet of the user are exercised. The exerciser includes a resistance mechanism which is located at the front end of the base together with the pedals and the swinging arms, and an adjustable seat is located at the rear end of the base. Therefore, when in maintenance to the resistance mechanism, the maintainers can directly access the resistance mechanism without removing the adjustable seat.

4 Claims, 5 Drawing Sheets

HANDS AND FEET EXERCISER

FIELD OF THE INVENTION

The present invention relates to an exerciser and more particularly, to an exerciser which exercises the user's both hands and feet.

BACKGROUND OF THE INVENTION

A conventional exerciser for exercising the user's hands and feet generally includes a base on the floor and two pedals are connected to a first mechanism which is located at a front end of the base so that the user's feet operates the pedals to be exercised. A mediate portion of the base has a crank and the user's hands operate the crank to exercise the hands.

However, both of the hands and the feet can only be exercised in one direction because the resistance mechanism can only be operated in one direction, and this restricts the exercise result.

U.S. Pat. No. 6,042,518 discloses a recumbent total body exerciser, wherein the user operates the left pedal to drive the right arm, and operates the right pedal to drive the left arm. The action is connected to a resistance mechanism installed at the rear end of the base via links and cams. The seat is located above the resistance mechanism.

It is inconvenient for maintenance to the resistance mechanism because the maintainers have to remove the seat to access the resistance mechanism.

The present invention intends to provide an exerciser wherein the alternative actions of the right pedal and the left pedal drive the right link and the left link so as to swing the right swinging arms and the left swinging arm. The efficiency for exercise is much higher than the conventional exerciser.

SUMMARY OF THE INVENTION

The present invention relates to an exerciser which comprises a base having a right frame and a second frame. A main shaft is connected to the right and left frames. A right passive wheel, a central active wheel and a left passive wheel are respectively mounted to the main shaft and located between the right and left frames. A right active shaft is connected to the right frame and a right active wheel is mounted to the right active shaft and located at an inner side of the right frame. A right belt is connected between the right active wheel and the right passive wheel. A left active shaft is connected to the left frame and a left active wheel is mounted to the left active shaft and located at an inner side of the left frame. A left belt is connected between the left active wheel and the left passive wheel. A resistance mechanism is connected on the base and has a central passive wheel. A central belt is connected between the central active wheel and the central passive wheel. A right link has a mediate portion thereof pivotably connected to the right active shaft and is located at an outside of the right frame. One end of the right link is connected to a right pedal and the other end of the right link is pivotably connected to a right swinging arm which is driven by the right pedal. A left link has a mediate portion thereof pivotably connected to the left active shaft and is located at an outside of the left frame. One end of the left link is connected to a left pedal and the other end of the left link is pivotably connected to a left swinging arm which is driven by the left pedal.

The primary object of the present invention is to provide an exerciser wherein both the hands and the feet of the user are exercised during operating the exerciser.

Another object of the present invention is to provide an exerciser wherein all of the resistance mechanism and the transmission mechanism are located at the front end of the base and only the adjustable seat is connected to the rear end of the base.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
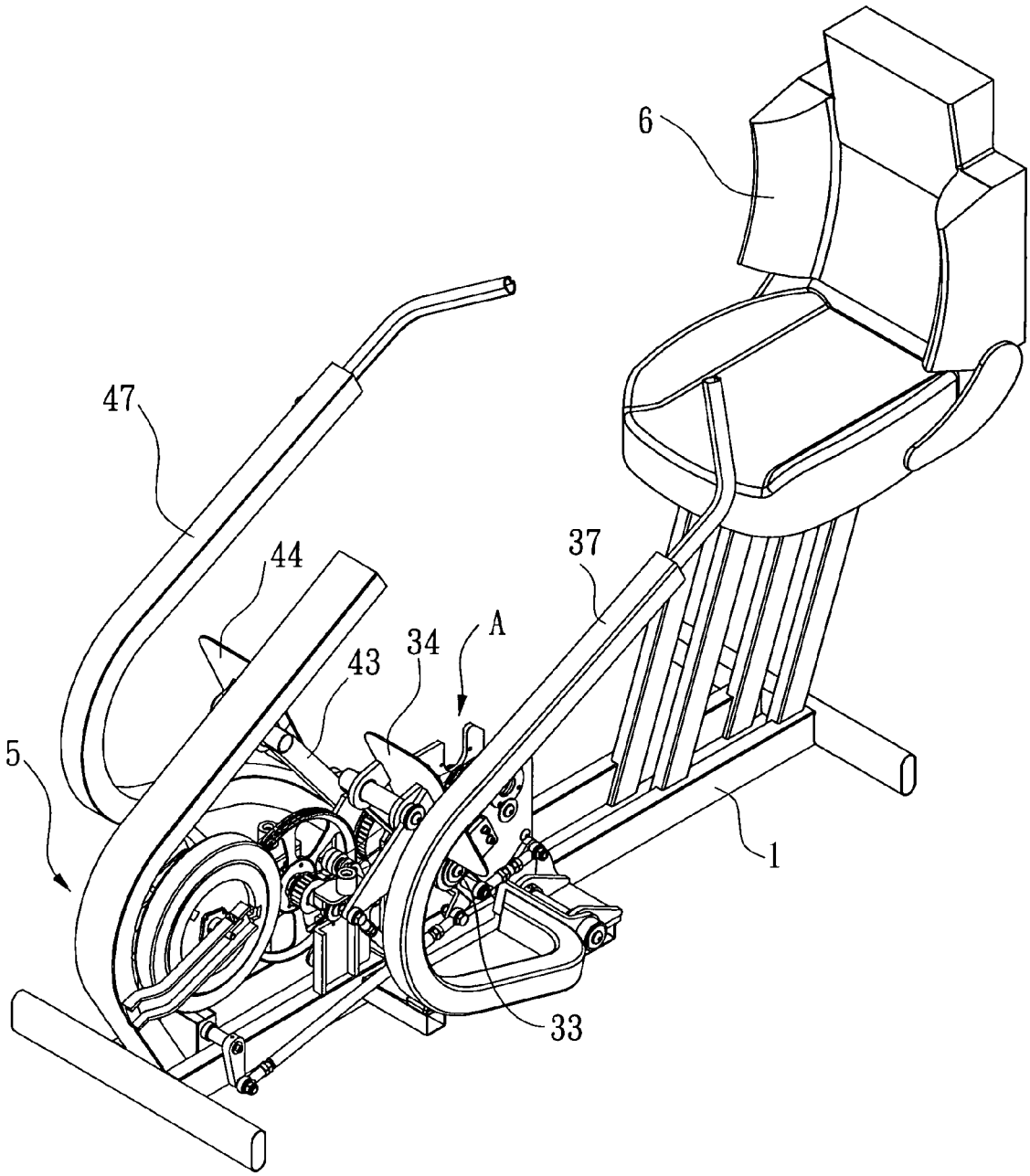
FIG. 1 is a perspective view to show the exerciser of the present invention.
Figure 2:
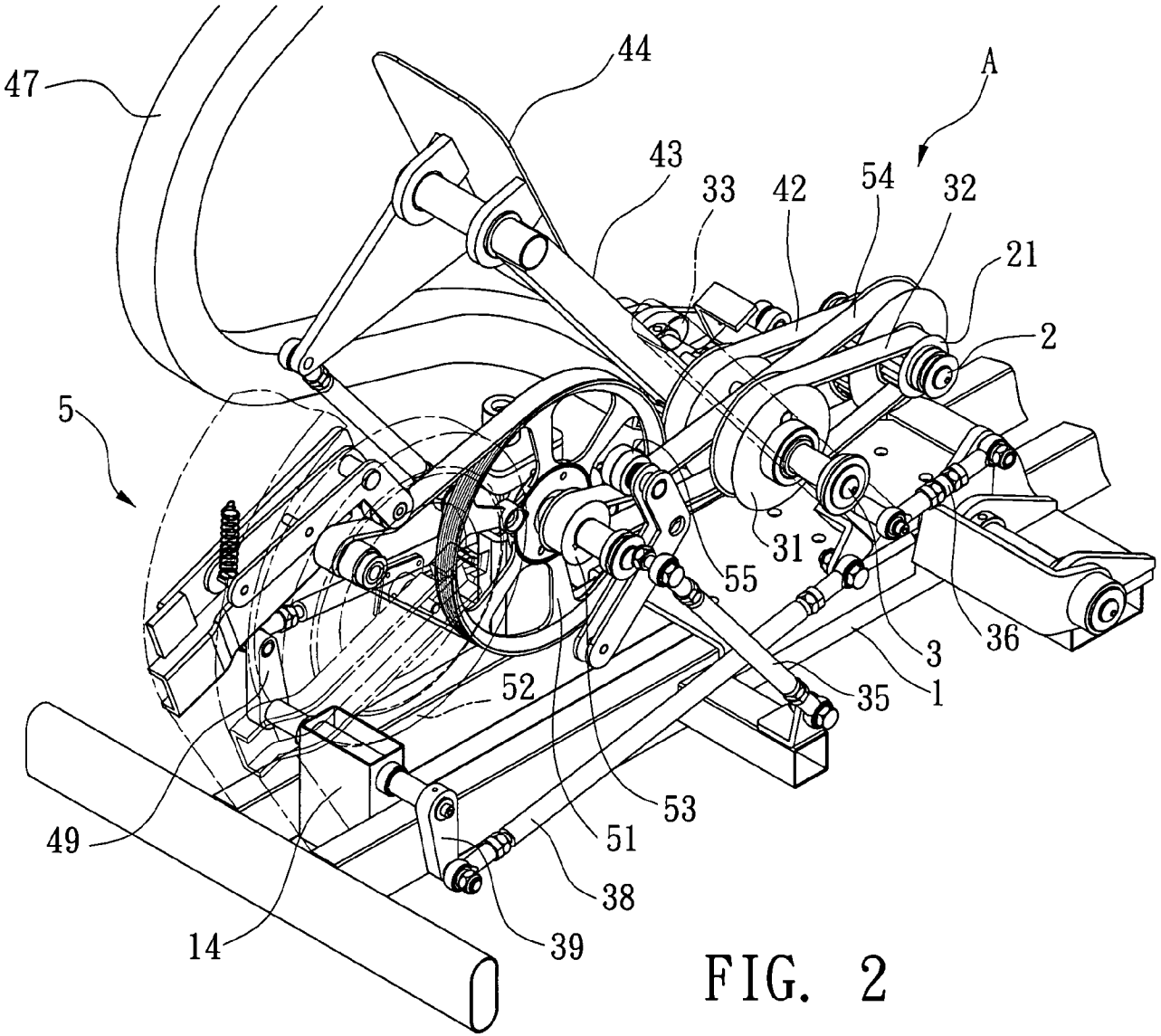
FIG. 2 is an enlarged partial perspective view of the exerciser of the present invention.
Figure 3:
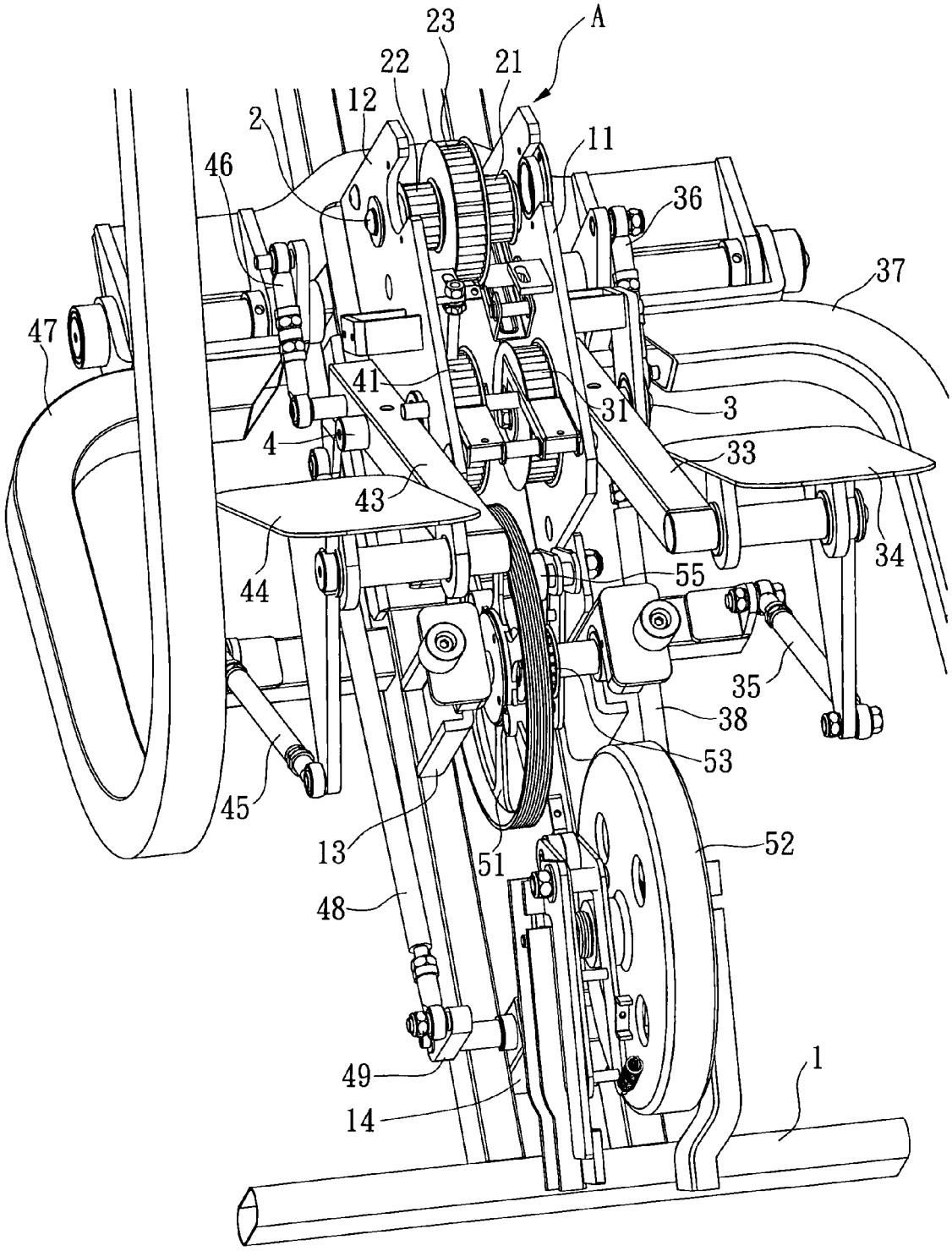
FIG. 3 is another enlarged partial perspective view of the exerciser of the present invention.
Figure 4:
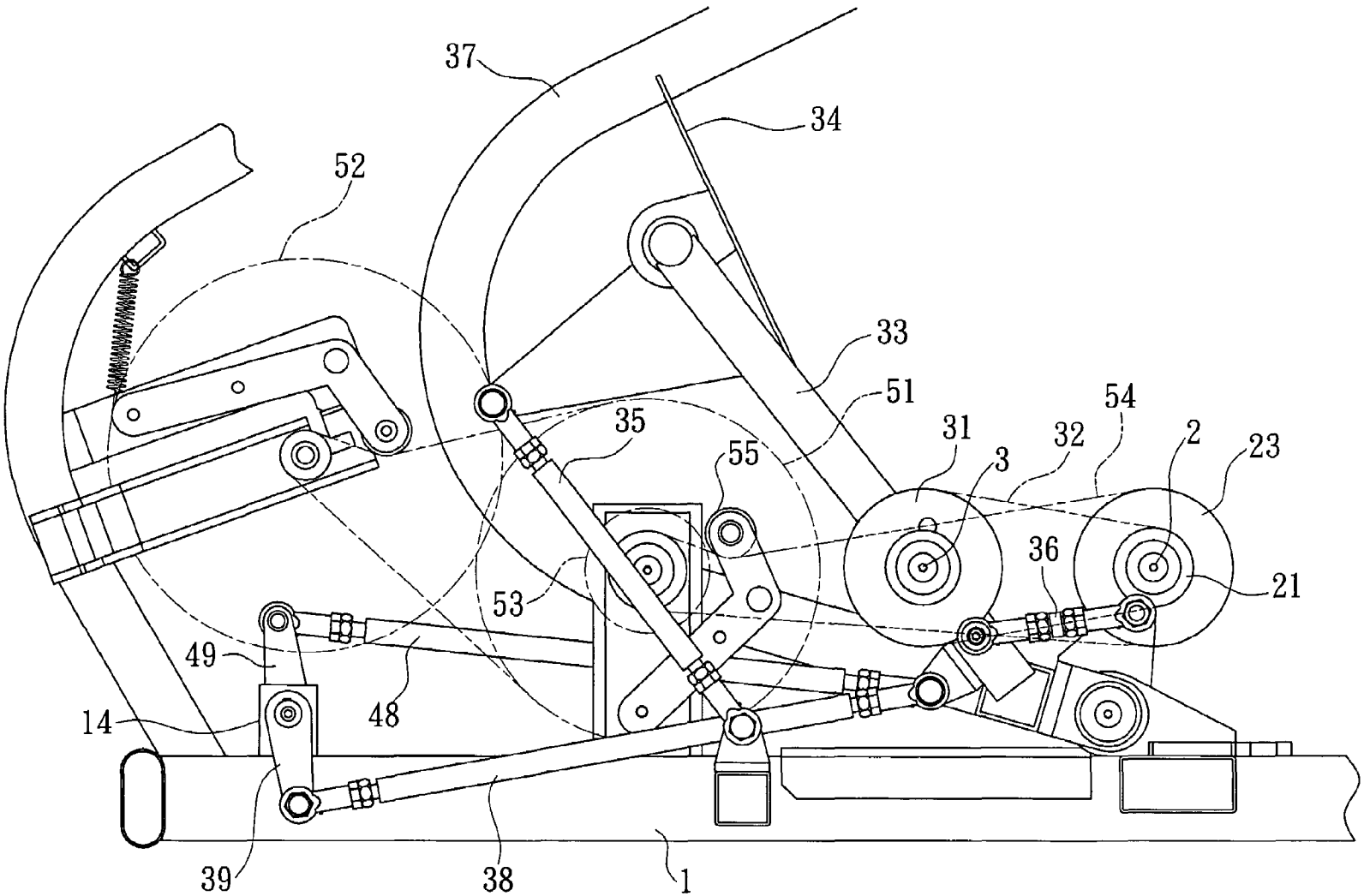
FIG. 4 is a side view of the exerciser of the present invention.

Referring to FIGS. 1 to 4, the exerciser of the present invention comprises a base 1 which has a right frame 11 and a second frame 12 which is located parallel to the right frame 11 so as to define a gap therebetween. A main shaft 2 is connected to the right and left frames 11, 12. A right passive wheel 21, a central active wheel 23 and a left passive wheel 22 are respectively mounted to the main shaft 2 and located in the gap between the right and left frames 11, 12. Two one-directional bearings (not shown are connected to the main shaft 2 and rotatable in two different directions so as to be respectively cooperated with the right passive wheel 21 and the left passive wheel 22. Therefore, when either one of the right passive wheel 21 and the left passive wheel 22 rotates clockwise, the other rotates in counter clockwise. The central active wheel 23 rotates in a fixed direction.

A right active shaft 3 is connected to the right frame 11 and a right active wheel 31 is mounted to the right active shaft 3 and located at an inner side of the right frame 11. A right belt 32 is connected between the right active wheel 31 and the right passive wheel 21. The right active wheel 31 drives the right passive wheel 21.

A left active shaft 4 is connected to the left frame 12 and a left active wheel 41 is mounted to the left active shaft 4 and located at an inner side of the left frame 12. A left belt 42 is connected between the left active wheel 41 and the left passive wheel 22. The left active wheel 41 drives the left passive wheel 22.

A resistance mechanism 5 is connected to two upright frames 13 on the base 1 and has a central passive wheel 53, a belt wheel 51 and a load wheel 52 which is driven by the belt wheel 51. The belt wheel 51 and the central passive wheel 53 share a common shaft and are connected to the upright frames 13. A central belt 54 is compressed by an idle wheel 55 and engaged with the central active wheel 23 and the central passive wheel 53. The central active wheel 23 can drive the central passive wheel 53.

A right link 33 has a mediate portion thereof pivotably connected to the right active shaft 3 and located at an outside of the right frame 11. One end of the right link 33 is connected to a right pedal 34 and the other end of the right link 33 is pivotably connected to a right swinging arm 37 which is driven by the right pedal 34. The right pedal 34 is pivotably connected to an end of a right rod 35 and the other end of the right rod 35 is pivotably connected to the base 1. The right link 33 is pivotably connected to an end of a right rear rod 36 and the other end of the right rear rod 36 is pivotably connected to the right swinging arm 37. A lower end of the right swinging arm 37 is pivotably connected to the base 1. The right link 33 is pivotably connected to an end of the right front rod 38 and the other end of the right front rod 38 is pivotably connected to a right crank 39. The right crank 39 is connected to a central frame 14 which is connected to the base 1.

A left link 43 has a mediate portion thereof pivotably connected to the left active shaft 4 and located at an outside of the left frame 12. One end of the left link 43 is connected to a left pedal 44 and the other end of the left link 43 is pivotably connected to a left swinging arm 47 which is driven by the left pedal 44. The left pedal 44 is pivotably connected to an end of a left rod 45 and the other end of the left rod 45 is pivotably connected to the base 1. The left link 43 is pivotably connected to an end of a left rear rod 46 and the other end of the left rear rod 46 is pivotably connected to the left swinging arm 47. A lower end of the left swinging arm 47 is pivotably connected to the base 1. The left link 43 is pivotably connected to an end of the left front rod 48 and the other end of the left front rod 48 is pivotably connected to a left crank 49. The left crank 49 and the right crank 39 are both connected to the central frame 14. The right crank 39 and the left crank 49 can be operated as the operation of the bicycle crank. An adjustable seat 6 is connected to the base 1.

Figure 5:
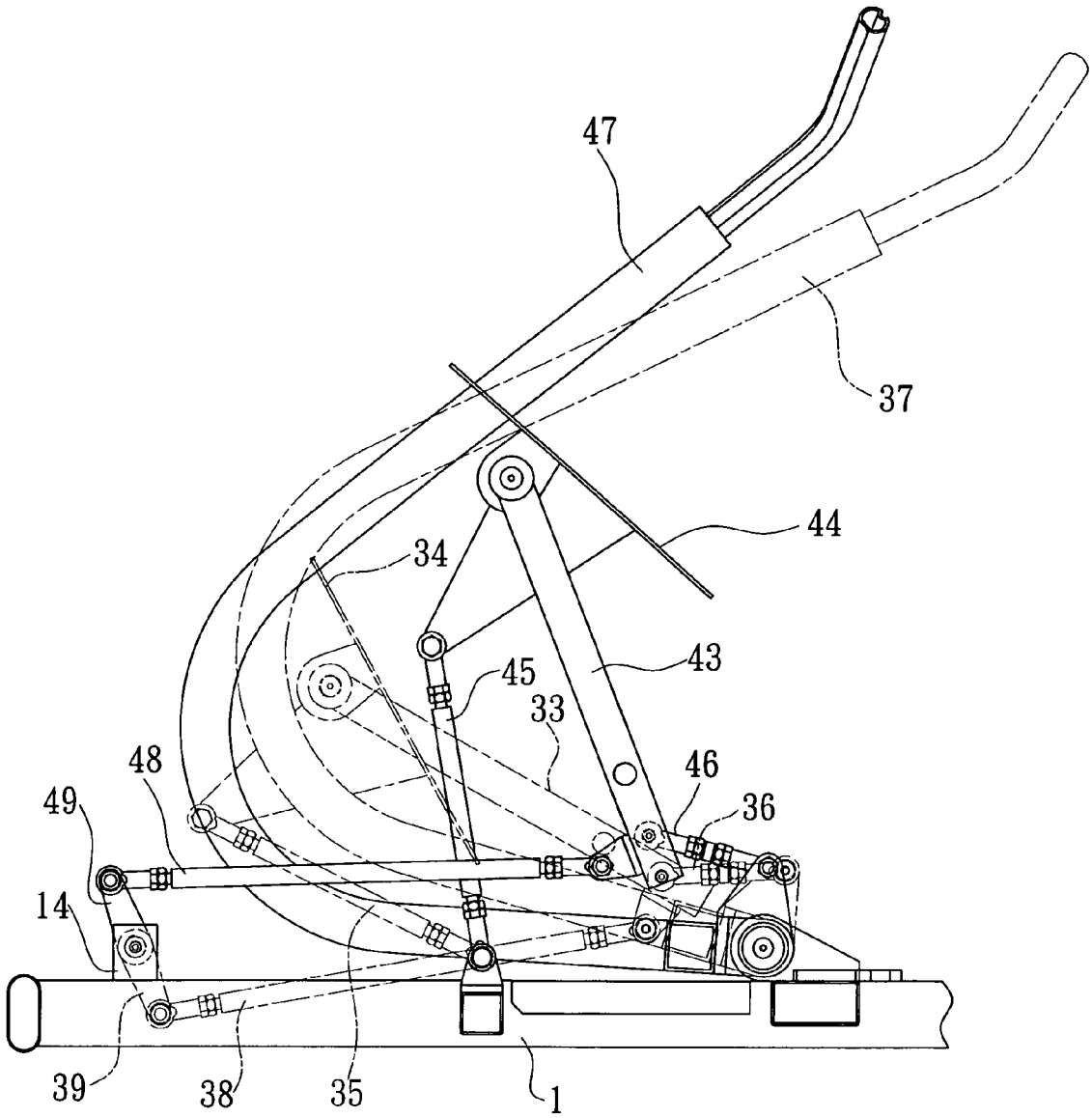
FIG. 5 is an enlarged partial side view of the exerciser of the present invention.

As shown in FIGS. 2 to 5, when the right pedal 34 is pushed downward, the right link 33 is driven to move forward and the right active wheel 31 together with the right passive wheel 21 both rotate forward. Because the central active wheel 23 and the right passive wheel 21 share a common shaft, so that the central passive wheel 53 and the belt wheel 51 and the load wheel 52 are rotated. The load wheel 52 generates a resistance to the user. Besides, because the one-direction bearing in the right passive wheel 21 and the one-direction bearing in the left passive wheel 22 are operated in opposite directions, so that the left passive wheel 22 is driven by the main shaft 2 to rotate backward. The left active wheel 41 rotates backward to drive the left link 43 to move backward. The left pedal 44 moves toward the user.

Furthermore, when the right pedal 34 drives the right link 33 to move forward, the right link 33 drives the right rear rod 36 and the right front rod 38 to move backward so that the right swinging arm 37 moves toward the user and swings backward. The right front rod 38 drives the right crank 39 to pivot backward so that the left crank 49 is pivoted forward and drives the left front rod 48 and left rear rod 46 to move forward. The left swinging arm 47 pivots forward. The lower end of the left link 43 pivots forward and the top end of the left link 43 pivots backward. The left pedal 44 moves toward the user and moves backward.

Of course, when the user operates the left pedal 44 downward, the right pedal 34 pivots backward and the right swinging arm 37 pivots forward and away from the user. The left swinging arm 47 pivots backward. By the alternatively operation of the two feet and hands, both of the hands and feet of the user are exercised.

The user's feet operates the right and left pedals 34, 44 alternatively and the user's hands operate the right and left links 33, 43 alternatively so that both of the hands and feet can be exercised. Besides, the resistance mechanism 5 and all of the parts are located at the front end of the base 1 and only the adjustable seat 6 is located at the rear end of the base 1, so that the resistance mechanism can be easily accessible without removing the adjustable seat 6.

While we have shown and described the embodiment in accordance with the present invention, it should be clear to those skilled in the art that further embodiments may be made without departing from the scope of the present invention.

What is claimed is:

1. An exerciser comprising:

a base having a right frame and a second frame which is located parallel to the right frame;

a main shaft connected to the right and left frames, a right passive wheel, a central active wheel and a left passive wheel respectively mounted to the main shaft and located between the right and left frames;

a right active shaft connected to the right frame and a right active wheel mounted to the right active shaft and located at an inner side of the right frame, a right belt connected between the right active wheel and the right passive wheel;

a left active shaft connected to the left frame and a left active wheel mounted to the left active shaft and located at an inner side of the left frame, a left belt connected between the left active wheel and the left passive wheel;

a resistance mechanism connected on the base and having a central passive wheel and a central belt connected between the central active wheel and the central passive wheel;

a right link having a mediate portion thereof pivotably connected to the right active shaft and located at an outside of the right frame, one end of the right link connected to a right pedal and the other end of the right link being pivotably connected to a right swinging arm which is driven by the right pedal, and a left link having a mediate portion thereof pivotably connected to the left active shaft and located at an outside of the left frame, one end of the left link connected to a left pedal and the other end of the left link being pivotably connected to a left swinging arm which is driven by the left pedal.

2. The exerciser as claimed in claim 1, wherein the right pedal is pivotably connected to an end of a right rod and the other end of the right rod is pivotably connected to the base, the right link is pivotably connected to an end of a right rear rod, the other end of the right rear rod is pivotably connected to the right swinging arm, a lower end of the right swinging arm is pivotably connected to the base, the right link is pivotably connected to an end of a right front rod and the other end of the right front rod is pivotably connected to a right crank, the right crank is connected to a central frame which is connected to the base, the left pedal is pivotably connected to an end of a left rod and the other end of the left rod is pivotably connected to the base, the left link is pivotably connected to an end of a left rear rod, the other end of the left rear rod is pivotably connected to the left swinging arm, a lower end of the left swinging arm is pivotably connected to the base, the left link is pivotably connected to an end of a left front rod and the other end of the left front rod is pivotably connected to a left crank, the left crank and the right crank are both connected to the central frame.

3. The exerciser as claimed in claim 1, wherein the resistance mechanism is connected to upright frames on the base and includes a belt wheel and a load wheel which is driven by the belt wheel, the belt wheel and the central passive wheel share a common shaft and connected to the upright frames, the central belt being compressed by an idle wheel and engaged with the central active wheel and the central passive wheel.

4. The exerciser as claimed in claim 1, wherein an adjustable seat is connected to the base.

* * * * *